US008206474B2

(12) United States Patent
Tank et al.

(10) Patent No.: US 8,206,474 B2
(45) Date of Patent: Jun. 26, 2012

(54) ABRASIVE COMPACTS

(76) Inventors: Klaus Tank, Essexwold (ZA); Roy Derrick Achilles, Johannesburg (ZA)

( * ) Notice: Subject to any disclaimer, the term of this patent is extended or adjusted under 35 U.S.C. 154(b) by 450 days.

(21) Appl. No.: 12/375,984

(22) PCT Filed: Jul. 30, 2007

(86) PCT No.: PCT/IB2007/053001

§ 371 (c)(1), (2), (4) Date: Oct. 13, 2009

(87) PCT Pub. No.: WO2008/015629

PCT Pub. Date: Feb. 7, 2008

(65) Prior Publication Data

US 2010/0043302 A1 Feb. 25, 2010

(30) Foreign Application Priority Data

Jul. 31, 2006 (ZA) ..... 06/6329

(51) Int. Cl.

| | |
|---|---|
| ***B24D 3/02*** | (2006.01) |
| ***C09C 1/68*** | (2006.01) |
| ***C09K 3/14*** | (2006.01) |
| ***E21B 10/36*** | (2006.01) |

(52) U.S. Cl. ..... 51/307; 175/428

(58) Field of Classification Search ..... 51/307, 51/309; 175/428

See application file for complete search history.

(56) References Cited

U.S. PATENT DOCUMENTS

| | | | |
|---|---|---|---|
| 4,505,746 | A | 3/1985 | Nakai et al. |
| 5,200,372 | A | 4/1993 | Kuroyama et al. |
| 5,468,268 | A | 11/1995 | Tank et al. |
| 5,505,748 | A | 4/1996 | Tank et al. |
| 7,074,247 | B2 | 7/2006 | Tank et al. |
| 2004/0037948 | A1 | 2/2004 | Tank et al. |
| 2005/0139397 | A1 | 6/2005 | Achilles et al. |
| 2006/0166615 | A1 | 7/2006 | Tank et al. |
| 2006/0236616 | A1 | 10/2006 | Wan |
| 2006/0260850 | A1 | 11/2006 | Roberts et al. |
| 2007/0017710 | A1 | 1/2007 | Achilles et al. |
| 2007/0181348 | A1 | 8/2007 | Lancaster et al. |

FOREIGN PATENT DOCUMENTS

| | | |
|---|---|---|
| JP | 60-48260 | 3/1985 |
| WO | 02 34437 | 5/2002 |
| WO | 2004 076800 | 9/2004 |

*Primary Examiner* — Anthony J Green
*Assistant Examiner* — Pegah Parvini
(74) *Attorney, Agent, or Firm* — Oblon, Spivak, McClelland, Maier & Neustadt, L.L.P.

(57) ABSTRACT

An abrasive compact having at least a tri-modal particle size distribution, and a binder phase, define a plurality of interstices. The binder phase is distributed in the interstices to form binder pools that correspond substantially in average size to that of an ultrahard polycrystalline composite material having a monomodal particle size distribution and substantially the same overall average particle grain size.

6 Claims, 1 Drawing Sheet

ABRASIVE COMPACTS

CROSS-REFERENCE TO RELATED APPLICATIONS

This application is a National Stage of PCT/IB07/53001 filed Jul. 30, 2007 and claims the benefit of South African patent application 2006/06239 filed Jul. 31, 2006.

BACKGROUND OF THE INVENTION

This invention relates to abrasive compacts.

Abrasive compacts are used extensively in cutting, milling, grinding, drilling and other abrasive operations. Abrasive compacts consist of a mass of ultrahard particles, typically diamond or cubic boron nitride, bonded into a coherent, polycrystalline conglomerate. The abrasive particle content of abrasive compacts is high and there is generally an extensive amount of direct particle-to-particle bonding or contact. Abrasive compacts are generally sintered under elevated temperature and pressure conditions at which the abrasive particle, be it diamond or cubic boron nitride, is crystallographically or thermodynamically stable.

Some abrasive compacts may additionally have a second phase which contains a catalyst/solvent or binder material. In the case of polycrystalline diamond compacts, this second phase is typically a metal such as cobalt, nickel, iron or an alloy containing one or more such metals. In the case of PCBN compacts this binder material typically comprises various ceramic compounds.

Abrasive compacts tend to be brittle and in use they are frequently supported by being bonded to a cemented carbide substrate or support. Such supported abrasive compacts are known in the art as composite abrasive compacts. Composite abrasive compacts may be used as such in a working surface of an abrasive tool. The cutting surface or edge is typically defined by the surface of the ultrahard layer that is furthest removed from the cemented carbide support.

Examples of composite abrasive compacts can be found described in U.S. Pat. Nos. 3,745,623; 3,767,371 and 3,743,489.

Composite abrasive compacts are generally produced by placing the components necessary to form an abrasive compact, in particulate form, on a cemented carbide substrate. The composition of these components is typically manipulated in order to achieve a desired end structure. The components may, in addition to ultrahard particles, comprise solvent/catalyst powder, sintering or binder aid material. This unbonded assembly is placed in a reaction capsule which is then placed in the reaction zone of a conventional high pressure/high temperature apparatus. The contents of the reaction capsule are then subjected to suitable conditions of elevated temperature and pressure.

It is desirable to improve the abrasion resistance of the ultrahard abrasive layer as this allows the user to cut, drill or machine a greater amount of the workpiece without wear of the cutting element. This is typically achieved by manipulating variables such as average ultrahard particle grain size, overall binder content, ultrahard particle density and the like.

For example, it is well known in the art to increase the abrasion resistance of an ultrahard composite by reducing the overall grain size of the component ultrahard particles. Typically, however, as these materials are made more wear resistant they become more brittle or prone to fracture. Abrasive compacts designed for improved wear performance will therefore tend to have poor impact strength or reduced resistance to spalling. This trade-off between the properties of impact resistance and wear resistance makes designing optimised abrasive compact structures, particularly for demanding applications, inherently self-limiting.

Additionally, because finer grained structures will typically contain more solvent/catalyst or metal binder, they tend to exhibit reduced thermal stability when compared to coarser grained structures. This reduction in optimal behaviour for finer grained structures can cause substantial problems in practical application where the increased wear resistance is nonetheless required for optimal performance.

Prior art methods to solve this problem have typically involved attempting to achieve a compromise by combining the properties of both finer and coarser ultrahard particle grades in various manners within the ultrahard abrasive layer.

An approach to solving the problem of achieving an optimal marriage of properties between coarser- and finer-grained structures lies in the use of intimate powder mixtures of ultrahard grains of differing sizes. These are typically mixed as homogenously as possible prior to sintering the final compact. Both bimodal distributions (comprising two particle size fractions) and multimodal distributions (comprising three or more fractions) of ultrahard particles are known in the art.

U.S. Pat. No. 4,604,106 describes a composite polycrystalline diamond compact that comprises at least one layer of interspersed diamond crystals and pre-cemented carbide pieces which have been sintered together at ultra high pressures and temperatures. In one embodiment, a mixture of diamond particles is used, 65% of the particles being of the size 4 to 8 μm and 35% being of the size 0.5 to 1 μm. A specific problem with this solution is that the cobalt cemented carbide reduces the abrasion resistance of that portion of the ultrahard layer.

U.S. Pat. No. 4,636,253 teaches the use of a bimodal distribution to achieve an improved abrasive cutting element. Coarse diamond (larger than 3 μm in particle size) and fine diamond (smaller than 1 μm in particle size) is combined such that the coarse fraction comprises 60 to 90% of the ultrahard particle mass; and the fine fraction comprises the remainder. The coarse fraction may additionally have a trimodal distribution.

U.S. Pat. No. 5,011,514 describes a thermally stable diamond compact comprising a plurality of individually metal-coated diamond particles wherein the metal coatings between adjacent particles are bonded to each other forming a cemented matrix. Examples of the metal coating are carbide formers such as tungsten, tantalum and molybdenum. The individually metal-coated diamond particles are bonded under diamond synthesis temperature and pressure conditions. The patent further discloses mixing the metal-coated diamond particles with uncoated smaller sized diamond particles which lie in the interstices between the coated particles. The smaller particles are said to decrease the porosity and increase the diamond content of the compact. Examples of bimodal compacts (two different particle sizes), and trimodal compacts, (three different particles sizes), are described.

U.S. Pat. Nos. 5,468,268 and 5,505,748 describe the manufacture of ultrahard compacts from a mass comprising a mixture of ultrahard particle sizes. The use of this approach has the effect of widening or broadening of the size distribution of the particles allowing for closer packing and minimizing of binder pool formation, where a binder is present.

U.S. Pat. No. 5,855,996 describes a polycrystalline diamond compact which incorporates different sized diamond. Specifically, it describes mixing submicron sized diamond particles together with larger sized diamond particles in order to create a more densely packed compact.

U.S. Pat. Application No. 2004/0062928 further describes a method of manufacturing a polycrystalline diamond compact where the diamond particle mix comprises about 60 to 90% of a coarse fraction having an average particle size ranging from about 15 to 70 μm and a fine fraction having an average particle size of less than about one half of the average particle size of the coarse fraction. It is claimed that this blend results in an improved material behaviour.

The problem with this general approach is that whilst it is possible to improve the wear and impact resistances when compared with either the coarse or fine-grained fraction alone, these properties still tend to be compromised i.e. the blend has a reduced wear resistance when compared to the finer grained material alone and a reduced impact resistance when compared to the coarser grained fraction. Hence the result of using an intimate mixture of particle sizes is simply to achieve the property of the average intermediate particle size.

The development of an abrasive compact that can achieve improved properties of impact and fatigue resistance consistent with coarser grained materials, whilst still retaining the superior wear resistance of finer grained materials, is therefore highly desirable.

SUMMARY OF THE INVENTION

Figure 1:
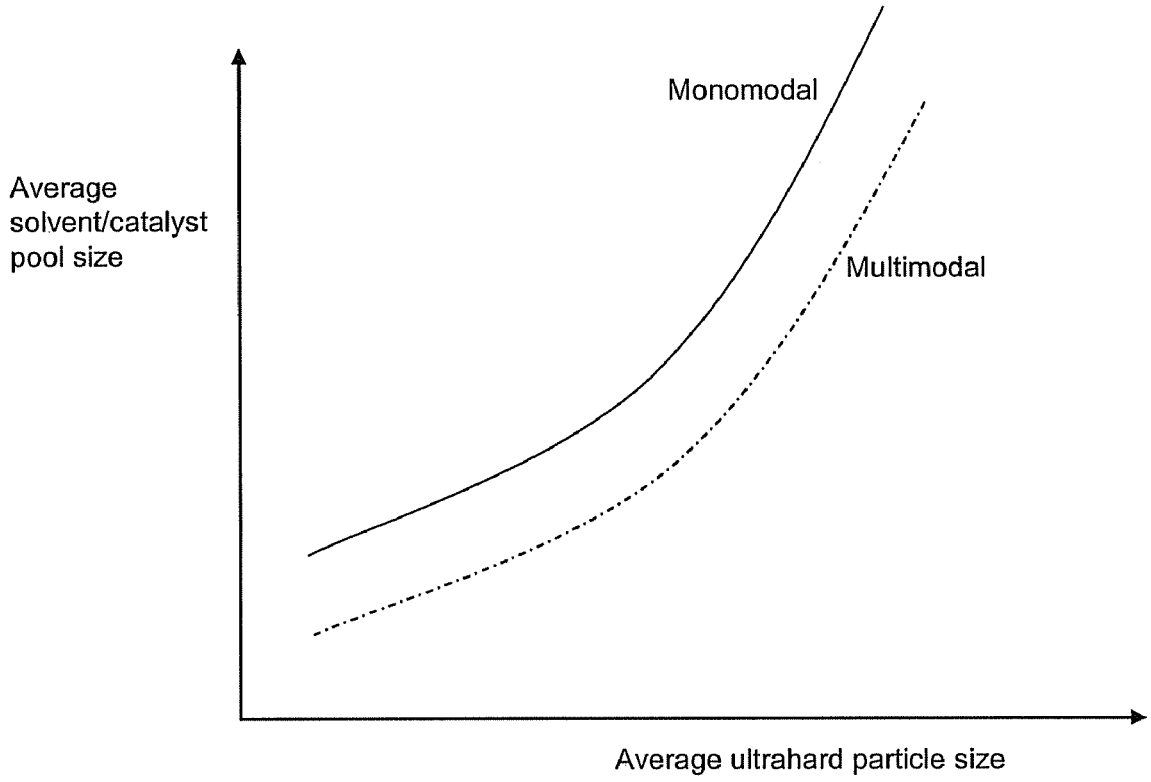
FIG. 1 shows the relationship between the average ultrahard particle size and the expected catalyst/solvent pool size.

According to a first aspect of the invention, there is provided an abrasive compact comprising an ultrahard polycrystalline composite material comprised of ultrahard abrasive particles having at least three different average particle grain sizes i.e. at least a tri-modal particle size distribution, and a binder phase, the ultrahard polycrystalline composite material defining a plurality of interstices, the binder phase being distributed in the interstices to form binder pools, characterised in that the average sizes of the binder pools corresponds substantially to that of an ultrahard polycrystalline composite material having a monomodal particle size distribution and substantially the same overall average particle grain size.

The invention further provides a method of manufacturing an abrasive compact, including the steps of subjecting a mass of ultrahard abrasive particles in the presence of a binder phase to conditions of elevated temperature and pressure suitable for producing an abrasive compact, the method being characterized by the mass of ultrahard particles having at least three different average particle sizes, which are provided in suitable quantities and relative average particle sizes as to maximize the average size of the binder pools of the sintered compact.

The abrasive compacts of the invention preferably comprise ultrahard abrasive particles having an overall average particle grain size of less than about 10 microns.

The invention extends to the use of the abrasive compacts of the invention as abrasive cutting elements, for example for cutting or abrading of a substrate or in drilling applications.

DESCRIPTION OF PREFERRED EMBODIMENTS

The present invention is directed to abrasive compacts, in particular ultrahard polycrystalline abrasive compacts, made under high pressure/high temperature conditions. The abrasive compacts are characterised in that the binder phase is distributed in such a manner as to maximize the average size of the pools in relation to the overall average grain size of the ultrahard particles, where the ultrahard particle distribution is multimodal.

The ultrahard abrasive particles may be diamond or cubic boron nitride, but are preferably diamond particles.

The ultrahard abrasive particle mass will be subjected to known temperature and pressure conditions necessary to produce an abrasive compact. These conditions are typically those required to synthesize the abrasive particles themselves. Generally, the pressures used will be in the range 40 to 70 kilobars and the temperature used will be in the range 1300° C. to 1600° C.

The abrasive compact, particularly for diamond compacts, will generally be bonded to a cemented carbide support or substrate forming a composite abrasive compact. To produce such a composite abrasive compact, the mass of abrasive particles will be placed on a surface of a cemented carbide body before it is subjected to the elevated temperature and pressure conditions necessary for compact manufacture. The cemented carbide support or substrate may be any known in the art such as cemented tungsten carbide, cemented tantalum carbide, cemented titanium carbide, cemented molybdenum carbide or mixtures thereof. The binder metal for such carbides may be any known in the art such as nickel, cobalt, iron or an alloy containing one or more of these metals. Typically, this binder will be present in an amount of 10 to 20 percent by mass, but this may be as low as 6 percent by mass. Some of the binder metal will generally infiltrate the abrasive compact during compact formation.

The compacts and method for generating the compacts of the invention are typically characterized by the abrasive particle mixtures that are used. The ultrahard particles used in the present process can be natural or synthetic. The mixture is multimodal, i.e. comprises a mixture of fractions that differ from one another discernibly in their average particle size. By "average particle size" it is meant that the individual particles have a range of sizes with the mean particle size representing the "average". Hence the major amount of the particles will be close to the average size although there will be a limited number of particles above and below the specified size. The peak in the distribution of the particles will therefore be at the specified size. The size distribution for each ultrahard particle size fraction is typically itself monomodal, but may in certain circumstances be multimodal. In the sintered compact, the term "average particle grain size" is to be interpreted in a similar manner.

The abrasive compacts produced by the method of the invention additionally have a binder phase present. This binder material is preferably a catalyst/solvent for the ultrahard abrasive particles used. Catalyst/solvents for diamond and cubic boron nitride are well known in the art. In the case of diamond, the binder is preferably cobalt, nickel, iron or an alloy containing one or more of these metals. This binder can be introduced either by infiltration into the mass of abrasive particles during the sintering treatment, or in particulate form as a mixture within the mass of abrasive particles. Infiltration may occur from either a supplied shim or layer of the binder metal or from the carbide support. Typically a combination of approaches is used.

During the high pressure, high temperature treatment, the catalyst/solvent material melts and migrates through the compact layer, acting as a catalyst/solvent and hence causing the ultrahard particles to bond to one another through the formation of reprecipitated ultrahard phase. Once manufactured, the compact therefore comprises a coherent matrix of ultrahard particles bonded to one another, thereby forming an ultrahard polycrystalline composite material with many interstices containing binder or solvent/catalyst material as described above. In essence, the final compact therefore comprises a two-phase composite, where the ultrahard abrasive material comprises one phase and the binder or solvent/catalyst the other.

In one form, the ultrahard phase, which is typically diamond, constitutes between 85% and 95% by volume and the solvent/catalyst material the other 5% to 15%.

The relative distribution of the binder or solvent/catalyst phase is largely defined by the size and shape of the ultrahard component particles. It is well known in the art that the average grain size of the ultrahard material plays a major role in determining the average binder or catalyst/solvent pool size. Coarser grained sintered compacts will typically have far larger solvent/catalyst pools than finer-grained compacts. This can be understood by a consideration of simple packing theory for coarser particles versus finer particles. Therefore, in general, the voids left between closely packed coarser particles will be larger than those left in the voids between finer particles.

This situation is, however, complicated by an additional factor in that the increased surface area of finer ultrahard particles tends to increase the infiltration of solvent/catalyst metal via capillary action. Hence the overall solvent/catalyst content of finer grained compacts tends to be higher than that for coarser grained compacts. In order to accommodate this increase in catalyst/solvent level, the pool size will tend to increase somewhat over the expected pool size simply derived from a consideration of the void size between grains.

The manipulation of packing densities via the use of multimodal mixtures is a well-known method, as previously discussed, to achieve reduced solvent/catalyst pool size through increasing the ultrahard particle density. This has been shown in the art to result in a compact that typically has improved wear resistance over the monomodal case. It is therefore well-known that there exists a defined relationship between the average ultrahard particle size and the expected catalyst/solvent pool size, with the catalyst/solvent pool size being finer for the multimodal ultrahard particle distributions when compared with the monomodal distributions. Such a relationship is shown schematically in FIG. 1.

What is not known in the art, however, is the use of a specifically designed multimodal ultrahard particle mixture to achieve a structure that has increased catalyst/solvent pool sizes over a standard multimodal for the same average ultrahard particle grain size. Typically this would be seen as counter intuitive to producing an ultrahard compact of good wear resistance. However, it has surprisingly been found that by using a multimodal mixture tailored to produce larger then standard catalyst/solvent pool sizes, a compact of superior impact resistance is achieved without compromising significantly, if at all, on wear resistance.

A feature of this invention is therefore that the average catalyst/solvent pool size for the multimodal compact (i.e. comprises at least three different particle size fractions) of the invention is comparable to that obtained for a monomodal compact of the same average grain size. Thus, whilst exhibiting increased average catalyst/solvent pool size, the compact of the invention still exhibits a multimodal ultrahard particle distribution.

The measurement of the average catalyst/solvent pool size is carried out on the final compact by conducting a statistical evaluation of a large number of collected images taken on a scanning electron microscope. The binder or catalyst/solvent phase, which is easily distinguishable from that of the ultrahard phase using electron microscopy, can then be measured by estimating a circle equivalent in size for each individual microscopic area identified to be binder phase in the microstructure. The collected distribution of these circles is then evaluated statistically. An arithmetic average is then determined from this distribution.

Typically, the major fraction of the composite material, in the case of a tri-modal particle size distribution, comprises 65 to 75% of the ultrahard abrasive particles. A second, finer fraction, typically comprises about 15 to 20% of the ultrahard particles, wherein the average particle size of the finer fraction is no less than half that of the major fraction. Likewise a third, coarser fraction typically comprises 10 to 15% of the ultrahard particles, wherein the average size of the coarser fraction is no more than twice that of the major fraction.

The multimodal arrangement of the compacts of the invention can be generated by deviating from traditional packing theory in designing the ultrahard particle mixture. Traditionally, denser structures are achieved by mixing coarser and finer particles together in such a manner as to minimise the voids between the coarser particles by filling these with finer particles. A bimodal distribution can typically achieve this at a ratio of approximately ⅔ coarse particles to ⅓ fine particles where the coarse particles are roughly 10 times the size of the fine particles. Hence the character of the final mixture, even in the sintered compact, will show discrete peaks that are largely independent of one another. Whilst it is possible that the distributions may overlap, independent values for the component peak maxima are still easily measured. More complex multimodal mixtures have evolved further along these lines, to achieve a better fit where the coarser and finer fractions are closer in average size, but nonetheless have remained focussed on achieving better packing density through a similar approach and hence will also tend to show discrete peak maxima, independent of one another.

In order to achieve the preferred structure of the invention, it is desirable that the key monomodal fraction, which as mentioned above typically comprises 65% to 75% of the overall mix, be adjusted with fractions more similar in size to it than those typically used in multimodal recipes, in order to induce shoulders on the periphery of the size distributions i.e. on both coarser and finer sides. These should be roughly symmetrical in quantity and effect on the overall distribution. It is important to note that these additions provide a largely continuous effect on the overall size distribution i.e. they do not provide in themselves significant peak maxima independent of the base monomodal.

A preferred aspect of the invention is a multimodal structure that has an overall average particle size less than 10 μm.

A preferred embodiment of the invention uses a multimodal mixture comprising:

18 mass % diamond between 2 and 4 μm in size;

70 mass % diamond between 4 and 6 μm in size; and 12 mass % diamond between 8 and 10 μm in size.

An additional 1% of cobalt catalyst/solvent powder is admixed into the diamond powder mixtures as this has been found to aid in achieving optimal sintering processes for this system.

The resulting diamond compact of the preferred embodiment was analysed by scanning electron microscope at 1000 times magnification and found to have a catalyst/solvent pool size of 0.80 μm. Another more typical multimodal compact, i.e. one which the packing density thereof was optimised, with the same overall average diamond grain size was found to have an average catalyst/solvent pool size of 0.68 μm. A monomodal compact of the same average ultrahard particle size was found to have an average catalyst/solvent pool size of 0.79 μm. The wear resistance of the preferred embodiment of the compact of the invention was found to be improved over the monomodal compact, and comparable to that of the typical multimodal compact. In addition, the compact of the invention was found to have superior impact resistance.

The invention claimed is:

1. An abrasive compact comprising an ultrahard polycrystalline composite material, the ultrahard polycrystalline composite material comprising at least three different particle size fractions of ultrahard abrasive particles:

a major fraction comprising from 65% to 75% by mass of the polycrystalline composite material, at least one finer fraction having an average particle size of less than half that of the average particle size of the major fraction, wherein the finer particle size fraction comprising from about 15% to 20% by mass of the polycrystalline composite material, and at least one coarser fraction having an average particle size no more than twice that of the major fraction, wherein the coarser particle size fraction comprises from 10% to 15% by mass of the polycrystalline composite material.

2. An abrasive compact according to claim 1, having an overall average particle size of less than 10 μm.

3. An abrasive compact according to claim 1, wherein the ultrahard abrasive particles are diamond particles.

4. An abrasive compact according to claim 3, comprising about 15% by mass diamond particles having an average particle size of between 2 μm to less than 3 μm, about 70% by mass diamond particles having an average particle size of between 4 and 6 μm, and about 12% by mass diamond particles having an average particle size between 8 and 10 μm.

5. An abrasive compact according to claim 2, wherein the ultrahard abrasive particles are diamond particles.

6. An abrasive compact according to claim 5, comprising about 15% by mass diamond particles having an average particle size of between 2 μm to less than 3 μm, about 70% by mass diamond particles having an average particle size of between 4 and 6 μm, and about 12% by mass diamond particles having an average particle size between 8 and 10 μm.

* * * * *